US009364376B2

(12) United States Patent
Crawford et al.

(10) Patent No.: US 9,364,376 B2
(45) Date of Patent: Jun. 14, 2016

(54) SYSTEM AND METHOD FOR TRANSFERRING A WHEELED LOAD INTO A TRANSPORT VEHICLE

(76) Inventors: Raymond L. Crawford, Tucson, AZ (US); Jay G. Grogan, Tucson, AZ (US)

( * ) Notice: Subject to any disclaimer, the term of this patent is extended or adjusted under 35 U.S.C. 154(b) by 0 days.

(21) Appl. No.: 14/002,080

(22) PCT Filed: Mar. 16, 2012

(86) PCT No.: PCT/US2012/029525

§ 371 (c)(1),
(2), (4) Date: Aug. 28, 2013

(87) PCT Pub. No.: WO2012/125965

PCT Pub. Date: Sep. 20, 2012

(65) Prior Publication Data

US 2013/0336752 A1 Dec. 19, 2013

Related U.S. Application Data

(60) Provisional application No. 61/453,466, filed on Mar. 16, 2011.

(51) Int. Cl.

| | |
|---|---|
| ***A61G 3/02*** | (2006.01) |
| *A61G 3/06* | (2006.01) |
| *A61G 1/06* | (2006.01) |

(52) U.S. Cl.

CPC ..... *A61G 3/0236* (2013.01); *A61G 3/029* (2013.01); *A61G 3/0254* (2013.01); *A61G 3/0272* (2013.01); *A61G 1/06* (2013.01); *A61G 3/061* (2013.01); *A61G 2203/30* (2013.01); *A61G 2203/32* (2013.01); *A61G 2203/34* (2013.01); *A61G 2203/36* (2013.01);

(Continued)

(58) Field of Classification Search

CPC ..... B65G 53/48; B01J 3/02; B01J 8/002; A61G 3/061; A61G 1/06

USPC ..... 414/280

See application file for complete search history.

(56) References Cited

U.S. PATENT DOCUMENTS

| | | | |
|---|---|---|---|
| 3,831,996 A | 8/1974 | Layer | 296/19 |
| 4,078,269 A | 3/1978 | Weipert | 5/63 |

(Continued)

FOREIGN PATENT DOCUMENTS

| | | | |
|---|---|---|---|
| GB | 2468604 | 9/2010 | A61G 1/02 |

OTHER PUBLICATIONS

International Search Report and Written Opinion issued in counterpart PCT Appln. Serial No. PCT/US12/29525 on Jun. 22, 2012 (9 pgs.).

(Continued)

*Primary Examiner* — Ernesto Suarez
*Assistant Examiner* — Emery Hassan
(74) *Attorney, Agent, or Firm* — Hayes Soloway P.C.

(57) ABSTRACT

A simple, adjustable lift system to load a cot bearing a patient into and out of an ambulance and a method of transferring a load on a transport into a vehicle is provided. More specifically, the lift system provides a pair of rails that may be adjusted to accommodate any cot currently in use by an ambulance. The rail system is extendable and is operated by a linear actuator to couple to a cot or other transport and lift the cot or other transport to a height from which the cot may be laterally inserted into the ambulance without undue strain on the EMT, firefighter, or other user.

11 Claims, 21 Drawing Sheets

(52) U.S. Cl.
CPC ..... *A61G 2203/40* (2013.01); *A61G 2203/42* (2013.01); *A61G 2203/46* (2013.01)

(56) References Cited

U.S. PATENT DOCUMENTS

| | | | | |
|---|---|---|---|---|
| 5,022,105 | A | 6/1991 | Catoe | 5/11 |
| 5,253,973 | A | 10/1993 | Fretwell | 414/558 |
| 5,785,277 | A | 7/1998 | Manning et al. | 244/137.2 |
| 6,024,528 | A | 2/2000 | Taylor | 414/495 |
| 6,332,638 | B1 | 12/2001 | Menna | 296/20 |
| 7,140,055 | B2 | 11/2006 | Bishop et al. | 5/611 |
| 7,328,926 | B1 | 2/2008 | Myers et al. | 296/19 |
| 7,389,552 | B1 * | 6/2008 | Reed et al. | 5/86.1 |
| 7,398,571 | B2 | 7/2008 | Souke et al. | 5/611 |
| 7,478,855 | B2 | 1/2009 | Lambarth et al. | 296/20 |
| 7,520,551 | B2 | 4/2009 | Lambarth et al. | 296/20 |
| 7,540,047 | B2 | 6/2009 | Lambarth | 5/611 |
| 7,540,547 | B2 | 6/2009 | Lambarth et al. | 296/20 |
| 7,636,961 | B1 | 12/2009 | Starkey | 5/11 |
| 7,637,550 | B2 * | 12/2009 | Menna | 296/20 |
| 2005/0225107 | A1 * | 10/2005 | Mitchell et al. | 296/20 |
| 2006/0075558 | A1 | 4/2006 | Lambarth et al. | 5/611 |
| 2006/0181100 | A1 * | 8/2006 | Lambarth et al. | 296/20 |
| 2008/0211248 | A1 * | 9/2008 | Lambarth | 296/20 |
| 2009/0039666 | A1 | 2/2009 | Lambarth | 296/20 |
| 2010/0045059 | A1 * | 2/2010 | Bourgraf | B60P 1/003 296/19 |
| 2010/0083442 | A1 * | 4/2010 | Nash | 5/620 |
| 2010/0176618 | A1 | 7/2010 | Souke et al. | 296/20 |

OTHER PUBLICATIONS

PCT International Preliminary Report on Patentability issued in corresponding application PCT/US2012/029525, dated Sep. 17, 2013 (7 pgs).

* cited by examiner

SYSTEM AND METHOD FOR TRANSFERRING A WHEELED LOAD INTO A TRANSPORT VEHICLE

This invention relates to an ambulance cot loading and unloading device and methodology, as well as an ambulance cot support arrangement, especially suitable for ambulances. While the invention has particular use with cots in ambulances, other systems of wheeled cargo are also envisioned.

As is known, the use of cots or stretchers generally includes resting the stretcher on the ground at a minimum height to allow simplified manual transfer of a sick or injured person or patient onto the stretcher, and then raising the stretcher with the sick or injured person or patient on it up to a height similar to that of the loading plane of the ambulance. The sick or injured person or patient in the cot is then loaded into the ambulance in order to transport the sick or injured person or patient to the hospital, where the stretcher will once more have to be unloaded from the ambulance, hopefully without causing trauma or jolts to the sick or injured person or patient.

Ambulances use stretchers that are made and equipped to facilitate this procedure. Still, however, current practice requires the operators of the ambulance to physically bear the weight of the stretcher with the sick or injured person or patient on it. Increasingly, this weight means that the operators are subjected to a considerable physical strain.

Some stretchers known as "self-loading" are known, which comprise a rest plane for receiving and securing the patient in a lying position. The stretcher plane has at least two support legs that allow the stretcher to alternate between a height near the ground and a height that is approximately the same height as the loading plane of the ambulance.

Often, a spring-activated system enables the legs to open automatically, but only after the stretcher has been physically raised from the ground through the efforts of the operators. The raising operation therefore must be performed manually by at least two operators, who have to bend over in order to grip the stretcher and thus have to raise it by brute force before the support legs can be opened. As the raising of the stretcher is done after the sick or injured person or patient has been transferred onto the stretcher, this operation often represents a great strain and can lead to serious injury to the health operators performing it.

In order to alleviate this effort, stretchers for ambulances have been designed with and are provided with a motorised system for raising the stretcher on which the sick or injured person or patient is lying. A variety of such stretchers are currently on the market with various designs, each having their respective advantages and disadvantages. Private and public emergency service providers have in some instances invested significant funds to provide these specialized cots for their emergency response personnel. However, during the stages of loading and unloading the stretcher to and from the ambulance, the automatic carriage system must be kept in a retracted configuration, such that it cannot provide any rest support for the stretcher, the weight of which must therefore be physically supported by the health operatives.

Notwithstanding this significant investment, then, the operation of loading and unloading a cot with a sick or injured person or patient in it is very laborious and can cause serious physical injuries to the operatives doing it. Emergency medical service (EMS) personnel (or Emergency Medical Technicians "EMT"s) are required to handle the combined weight of the ambulance cot and the sick or injured person or patient during various stages of insertion of the ambulance cot into the cargo area of an ambulance. In some instances, there exists a risk of back injury to the EMS personnel as a result of this lifting and insertion as well as removal methodology. In addition, there is a risk of injury to the sick or injured person or patient on the ambulance cot when an EMS attendant is injured and is no longer able to support the ambulance cot when the ambulance cot is spaced above the ground during insertion or removal from the cargo area of the ambulance.

Current practices of loading a cot into an ambulance are cumbersome, expensive, and require a specialized cot for use with the loading and unloading device. Lift systems in the art employ complicated coupling and lifting mechanisms that cannot be employed on cots currently in use in an ambulance. Such systems can cost tens of thousands of dollars and require a duplicate investment by requiring emergency service providers to replace functional cots or stretchers with specialized cots that will work with the lift system.

There is accordingly a need for a simplified system that will function with a wide variety of existing cot structures.

The present invention provides among other things a simplified, inexpensive, adjustable patient transport lift system and a method of transferring a load on a transport into a vehicle. More specifically, the lift system provides a pair of rails that may be adjusted to accommodate any cot currently in use by an ambulance. The rail system is extendable and is operated by a linear actuator, a winch, a spring system or some combination to couple to a cot or other transport and lift the cot or other transport to a height from which the cot may be laterally inserted into the ambulance without undue strain on the EMT, firefighter, or other user.

It is an object of the invention to provide a lift system that prevents undue strain on EMT and other personnel charged with loading a load on a transport into a vehicle.

It is another object of the invention to provide a simple linear actuator mechanism to load a cot onto an ambulance.

It is another object of the invention to provide a lift mechanism that may be adjusted for use with existing cots used in ambulances in the industry.

It is another object of the invention to provide a method for transferring a load on a transport into a vehicle by lifting the load with a linear actuator system to a height sufficient to laterally insert the transport into the vehicle.

The above and other objects may be achieved using devices involving a lift system for use in loading a cot into and unloading a cot from an interior of an ambulance. The cot may be any cot currently in use having a head end, at least one load wheel, and a support frame. The lift system employs a rail coupled to the ambulance by a brace and further coupled to the ambulance at an axle that allows the rail to pivot. A linear actuator, winch, spring, or combination is also coupled to the ambulance and to the brace. The linear actuator, winch, spring, or combination is mechanically operated to vary the distance of the brace from the ambulance. The rail has an extension that may be extended from the length of the rail. An interface hook that may be detachably coupled to the support frame is coupled to the rail extension, typically near the end of the extension, so that movement of the brace pivots the extension to place at least a portion of the weight of the cot on the interface hook.

In one embodiment, the system includes a first and a second rail coupled to the ambulance at a brace and an axle. The brace, the axle, or both the brace and the axle may each be a single structure that spans the gap between the first rail and the second rail. The gap between the first rail and the second rail may be adjustable to accommodate any sized cot support frame. The axle of the rails may be supported on a leg that is adjustable with respect to its position relative to the floor of the ambulance. The leg may be adjusted in a direction perpendicular to the alignment of the rails, to allow the width between the rails to be customized.

Each rail is extendable, and has an interface hook to interact with the support frame of the cot. In a particular embodiment, the second interface hook is coupled to the cot support frame opposite to the first interface hook. The interface hook may be a generic hook that can accommodate a variety of support frames, or may be configured to form a partial or complete sleeve of a portion of a particular support frame. The linear actuator in the system is typically a motorized jack, that may, or may not, be supplemented by a spring system.

Leverage of the rail system about the pivot point may be increased by placing the actuator at a greater distance from the end of the ambulance where the cot is loaded into the ambulance. Typically, this means the linear actuator is placed near the driver's cab of the ambulance.

The above and other objects may be achieved using methods involving lifting a load on a transport into and out of a vehicle. The vehicle will have an interior floor at some height, and the transport will have a carriage, usually with wheels to allow movement of the transport, and a support frame. An extendable rail is provided that may be completely enclosed in the interior of the vehicle when the vehicle is in motion. The rail is coupled to the vehicle at a brace and an axle. The extension of the extendable rail may be detachably coupled to the transport, typically at the support frame. The rail is extended outside of the vehicle, and the brace is moved to pivot the rail about the axle. In one embodiment, the brace is coupled to the interior floor of the vehicle and is moved in direction substantially away from the interior floor of the ambulance. As the brace is moved up, the opposite end of the rail is pivoted down below the level of the interior floor of the ambulance. The extendable rail may be coupled to the transport without lifting the transport prior to coupling.

Once the transport is coupled to the rail, the brace is moved in the opposite direction, which may be back toward the interior floor of the ambulance. The rail is again pivoted about the axle, lifting the transport so that the carriage is at or slightly above the level of the interior floor of the vehicle. The transport may then be laterally inserted into the vehicle by collapsing the extendable rail.

In another embodiment, two rails are provided having a gap between the rails, and the gap between the rails is adjusted to accommodate a specific transport or transport support frame.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. Applicants further express that if the provisions of 35 U.S.C. §112, ¶6 are sought to be invoked to define the inventions, the claims will specifically and expressly state the exact phrases "means for" or "step for, and will also recite the word "function" (i.e., will state "means for performing the function of [insert function] "), without also reciting in such phrases any structure, material or act in support of the function.

A more complete understanding of the present invention may be derived by referring to the detailed description when considered in connection with the following illustrative figures. In the figures, like reference numbers refer to like elements or acts throughout the figures.

Figure 1:
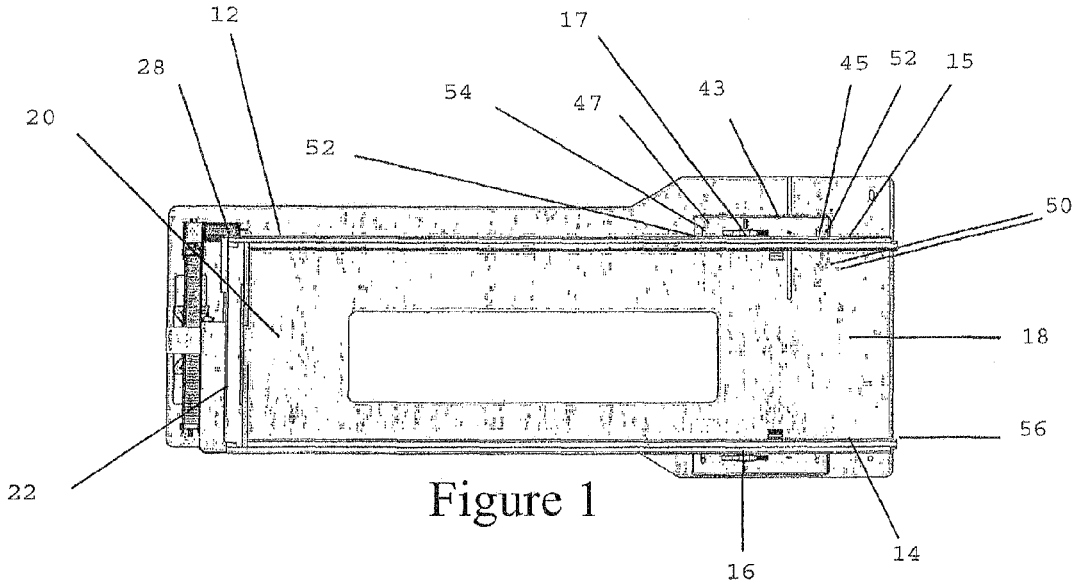
FIG. 1 depicts an overhead view of one embodiment of the transport patient lift system of the invention.

Elements and acts in the figures are illustrated for simplicity and have not necessarily been rendered according to any particular sequence or embodiment.

As used herein the terms "person" and "patient" are used interchangeably. The invention is not limited to transport of a person or patient, and may extend to a system and method of transporting other cargo.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

In one application of the invention, a device 1 for loading a cot 10 into an ambulance is provided. The device 1 may be added to any sized ambulance to assist in loading and unloading a cot 10 in an ambulance. While ambulance cots 10 are provided in a number of shapes and designs, some elements are nearly universal. As shown in particular in FIG. 6, an ambulance cot 10 includes a foldable wheel carriage 102 beneath a support frame 104. Cot 10 is configured to have a head end 106 and a feet end 108. The cot 10 is introduced into an ambulance with the head end 106 leading the feet end 108. Load wheels 110 rest on the floor of the interior of the ambulance and support at least a portion of the weight of the cot 10 as the wheel carriage 102 is folded beneath the cot 10. Currently, the EMT or firefighter or other emergency response personnel is required to support the remaining weight of the cot 10 and patient as the wheel carriage 102 is folded. The EMT or firefighter must then lift the cot 10 into a position substantially parallel to the interior floor of the ambulance and push the patient and the cot 10 into the ambulance. The load wheels 110 in conjunction with the transport wheels 112 facilitate complete entry of the cot into the ambulance.

Referring now to FIG. 1, in one embodiment, the device includes a base plate 12 to secure the device to the floor of the interior of the ambulance. Rails 14, 15 are coupled to an axle 19 by legs 16, 17. The legs 16, 17 are then securely coupled to the base 12. Alternatively, the axle 19 may be more closely coupled to the base 12 and the legs 16, 17 may span a distance between the axle 19 and the rails 14, 15. Rails 14, 15 form a u-shaped structure with an open end 18 and a closed end 20. A brace 22 spans the gap between the rails 14, 15 at the closed end 20. The shape of the rails 14, 15, or the brace 22 may be shaped to accommodate existing safety structures used to secure the cot 10 in an ambulance. The device 1 may be made of any suitable material. In a particular embodiment, the device 1 is composed of a powder coated steel/aluminum framework with precision hardened stainless-steel rails 14, 15.

Figure 5:
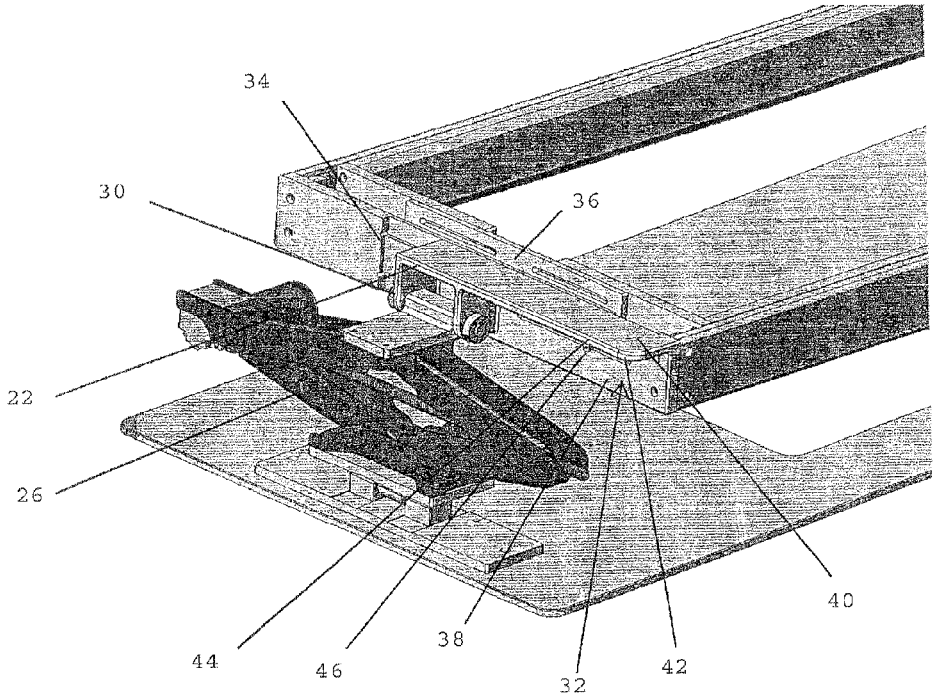
FIG. 5 depicts a close up perspective view of the brace and lift mechanism of the embodiment of FIG. 1.
Figure 6A:
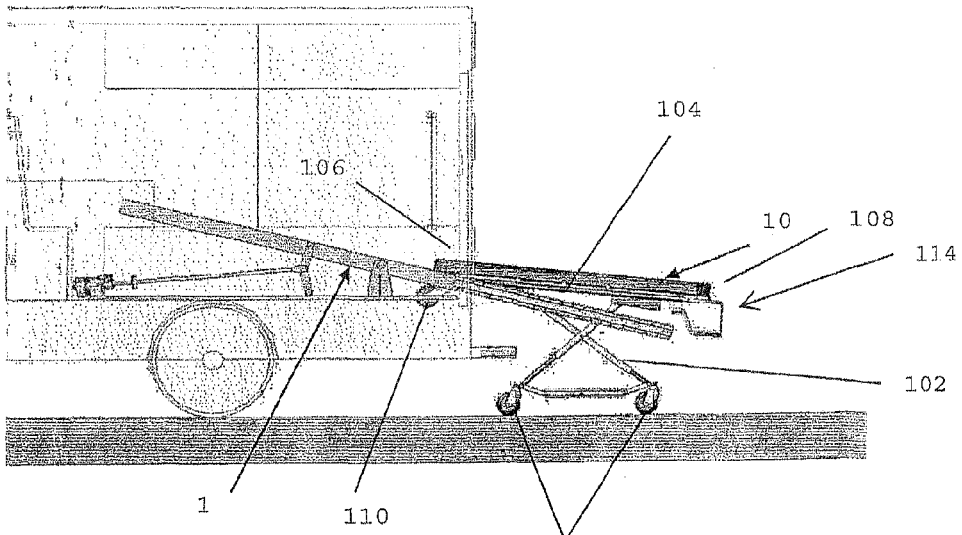
FIGS. 6A-6E depict an alternative embodiment of the transport patient lift system interacting with an ambulance.
Figure 6B:
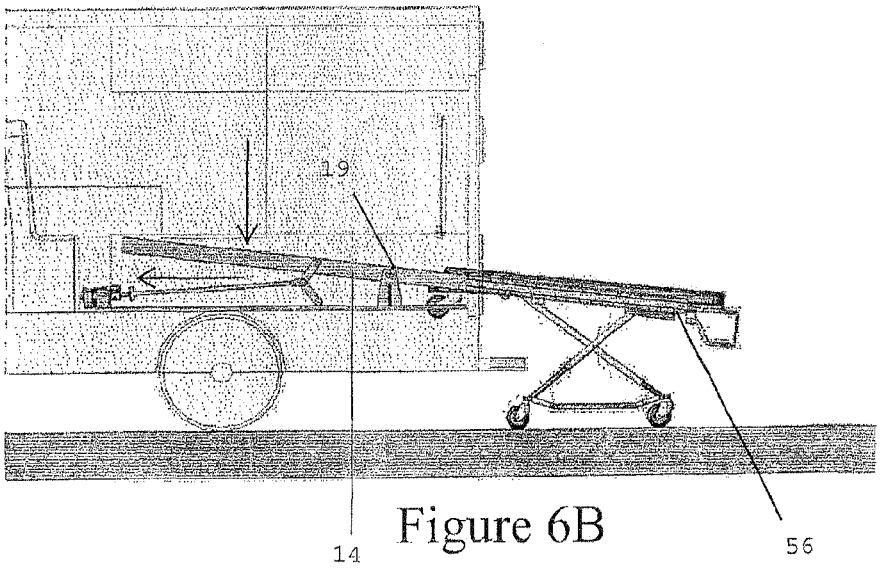
Figure 6C:
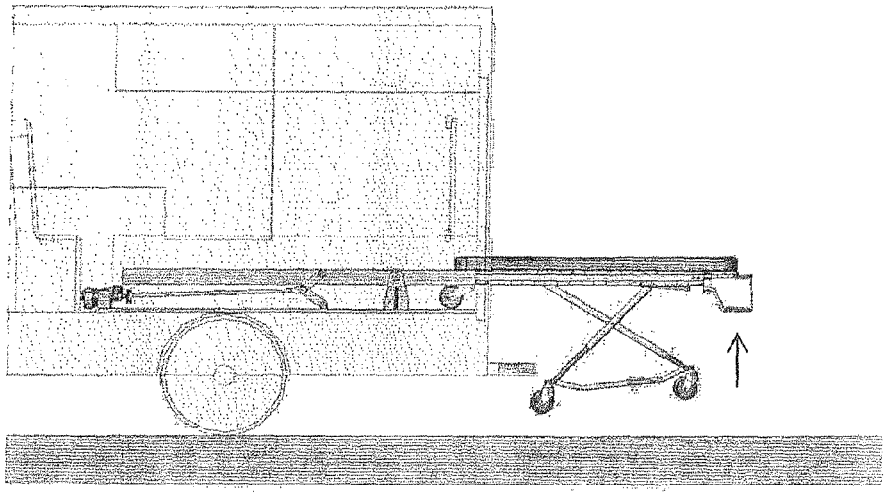
Figure 6D:
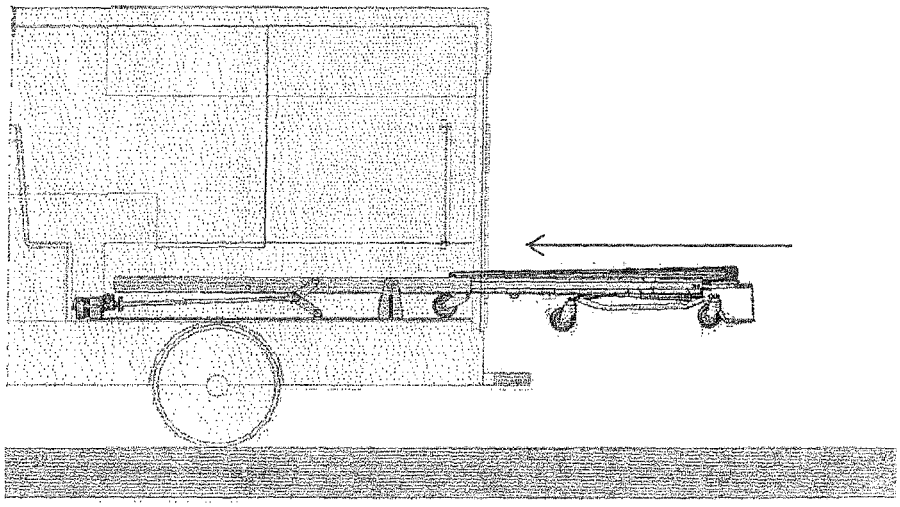
Figure 6E:
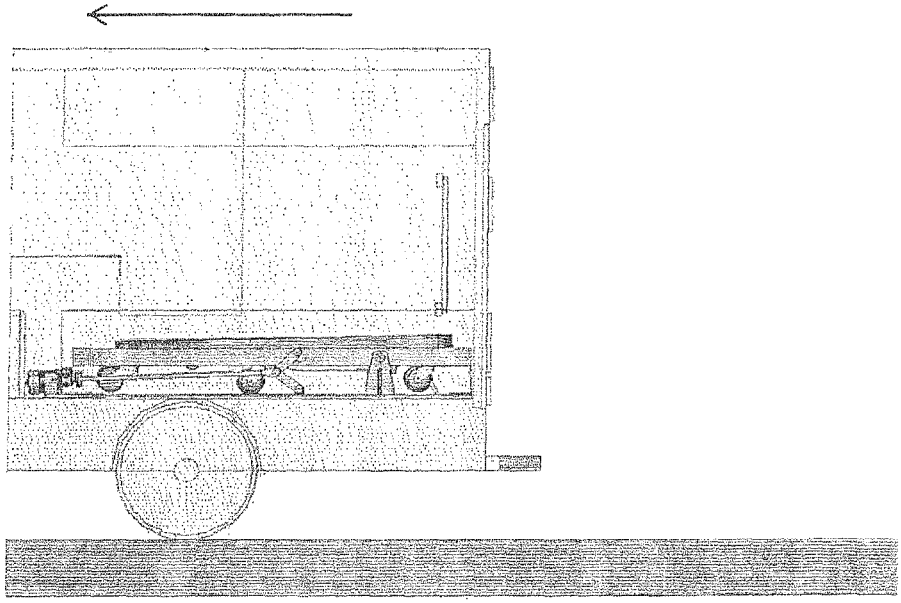

Brace 22 is coupled to a lift mechanism 24. Referring in particular to FIG. 5, the lift mechanism 24 may be a linear actuator 26. The linear actuator may include, but is not limited to, a mechanism such as a screw jack, a ball screw or roller screw actuator, a hoist, winch, rack and pinion, chain drive, belt drive, rigid chain or rigid belt actuator, a cam actuator, or a hydraulic, pneumatic, piezoelectric or electro-mechanical actuator. In a particular embodiment (not shown), the linear actuator is a screw-driven jack operated by an electronic motor. In another embodiment, the linear actuator is a winch coupled to the brace 22. In yet another embodiment, the linear actuator 26 is a spring system such as those commonly employed in opening a garage door. Alternatively, a spring system may be employed to supplement the actuation force of a jack or the pulling force of a winch to allow use of a less powerful motor to operate the jack or winch. In one embodiment, the motor is a 115 VAC, ⅓ HP motor coupled to a screw driven jack. In another embodiment, the motor 28 is a 1.5 HP 12VDC motor coupled to a utility winch, which is coupled to the brace 22 by a wire or strap.

As the motor 28 turns, the linear actuator 26 provides a linear thrust force to the brace 22 to provide the necessary force to lift (or lower) a loaded cot 10. In the case of a winch system, the motor 28 allows the wire or strap 29 to extend and gravity allows the extended rails 14, 15 to lower toward the ground. Operating the motor 28 in the opposite direction retracts the wire or strap 29 and the extended rails 14, 15 are leveraged about the axle 19, and lifted to a desired height level. The motion of the lift mechanism 24 should be fluid, and capable of lifting or lowering a loaded cot 10 in under approximately 30 seconds.

In one embodiment, linear actuator 26 is coupled to the brace 22 by hinge 30. Hinge 30 together with axle 19 allows the angle of the generally straight rails 14, 15 to change relative to the base plate 12 and the linear actuator 26 as the closed end 20 is lifted by the linear actuator 26. The hinge 30 and the axle 19 may be large aluminum-bronze bearings capable of repeatable motion at low rpm with little maintenance. As one having skill in the art will appreciate, many alternative mechanisms may be used to lift the closed end 20 from the base plate 12.

Brace 22 may have a fixed width or may have an adjustable width. Referring again in particular to FIG. 5, in one embodiment, the brace comprises a first plate 32 coupled to the first rail 14, a second plate 34 coupled to the second rail 15 and a third plate 36 coupled to both the first plate 32 and the second plate 34. The first plate 32 has an L shape with a vertical portion 38 and a horizontal portion 40. Horizontal portion 40 is coupled to the lift mechanism 24. Vertical portion 38 includes a slot 42. Slot 42 may be a straight slot with parallel edges, or may be shaped to allow the width between the rails 14, 15 to be adjusted to pre-determined settings. A bolt 44 with an adjusting nut 46 passes through the slot 42 and is coupled to the third plate 36. When the adjusting nut 46 is loosened, the first plate 32 may he moved relative to the third plate 36. The bolt 44 slides in the slot 42 to increase or decrease the total length of the brace 22, and the corresponding width between the rails 14, 15. When the space between the rails 14, 15 is the desired width, the adjusting nut 46 is tightened to secure the bolt 44 in place in the slot 42, fixing the length of the brace 22. Alternatively, the second plate 34 or the first and second plates 32, 34 may have a slot and be coupled to the third plate 36 to allow movement of the first plate 32, the second plate 34, or both relative to the third plate 36. The brace 22 may be shaped to accommodate a portion of the support frame 104 of the cot 10 to secure the cot 10 in the device during transport.

Figure 2:
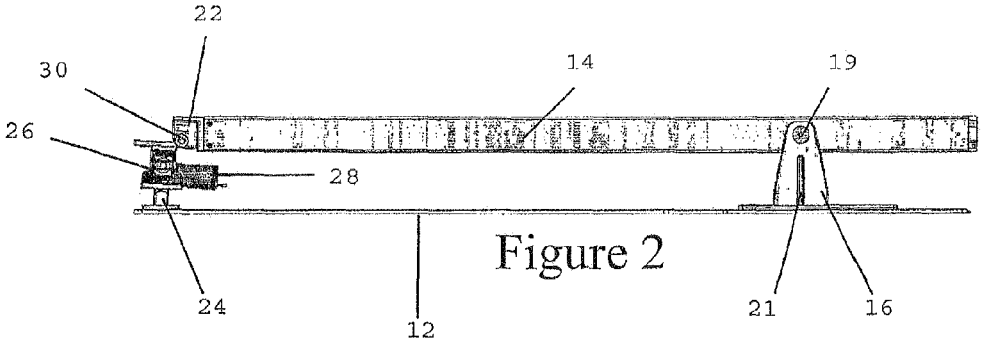
FIGS. 2 and 2A depict a side view of the embodiment of FIG. 1 with the linear actuator compressed and extended, respectively.
Figure 2A:
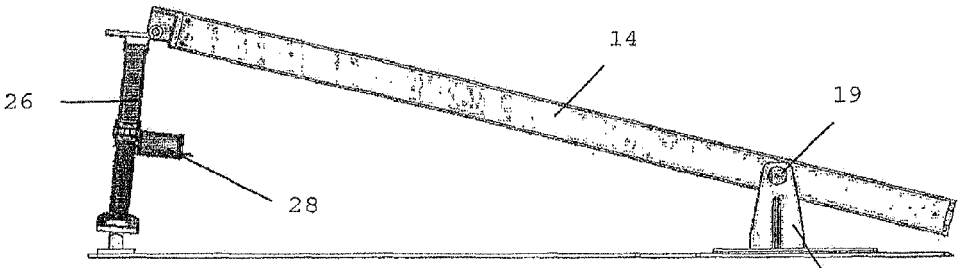

Referring to FIGS. 1-2, the legs 16, 17 support the axle 19 and are sized to allow the rails 14, 15 to lie parallel to the floor of the ambulance or other vehicle in which the device 1 is installed when the lift mechanism 24 is at its rest, or loaded, setting. In one embodiment, the legs 16, 17, are quite long, and the rails 14, 15 are positioned near the roof or ceiling of the interior of the ambulance. Alternatively, legs 16, 17 may support the rails 14, 15 and span a distance between the axle 19 and the rails 14, 15. When the brace has an adjustable width, the legs 16, 17 are also coupled to the base 12 in a manner which allows the distance between the rails 14, 15 to be adjusted. In one embodiment, at least one of the legs 16, 17 are coupled to the base 12 by an adjustment support 43. Adjustment support 43 is an extension, preferably of metal, lying substantially parallel to the plane of the base 12. The adjustment support 43 may be integral to the at least one leg 16, 17, or may be mechanically coupled to the at least one leg 16, 17.

Adjustment support 43 includes two base slots 45, 47 situated with the at least one leg 16, 17 evenly spaced between the base slots 45, 47. A series of holes 50 are in the base plate 12 aligned with the base slots 45, 47. Base bolts 52 pass through the base slots 46, 47 and into a hole 50. A base adjustment nut 54 may then fasten the adjustment support 43 in place relative to the base 12. Alternatively, the holes 50 may be threaded and the base bolts 52 may include a head that secures the adjustment support 43 in place when the base bolt 52 is screwed into the holes 50 in the base 12. The length of each base slot is slightly less than the space between adjacent holes 50, to allow a full range of movement of the at least one leg 16, 17 relative to the base 12. As one having skill in the art would recognize, there are several alternative methods of adjusting the position of the legs 16, 17 relative to the base plate 12 or the ambulance.

Figure 3A:
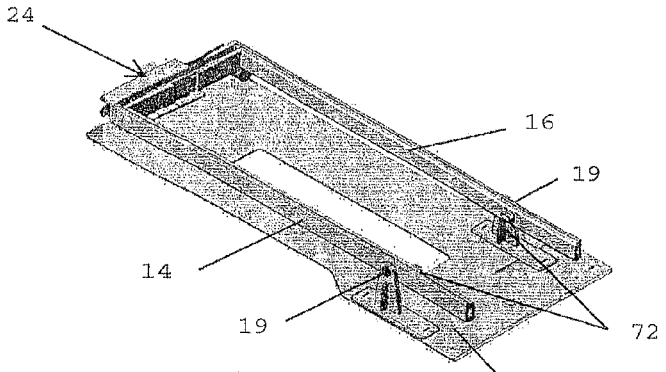
FIGS. 3A-3E depict the transport patient lift system of FIG. 1 in various states of operation.
Figure 3B:
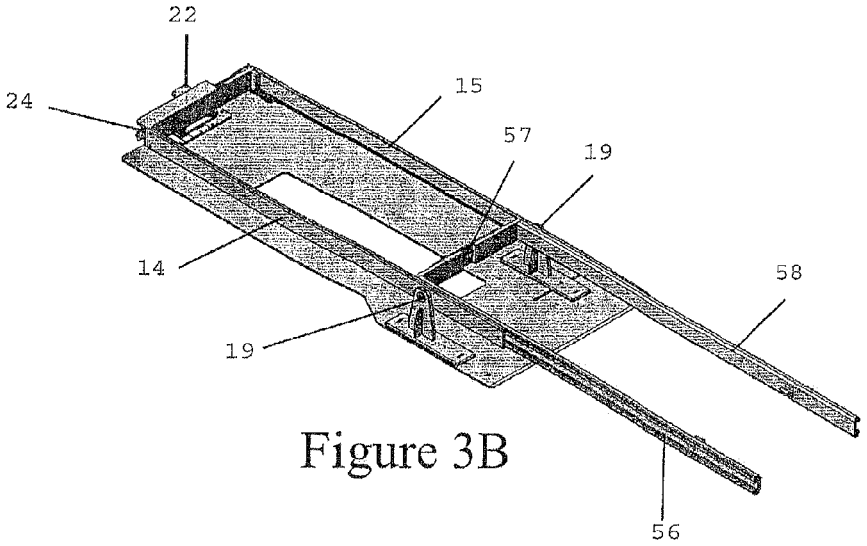
Figure 4:
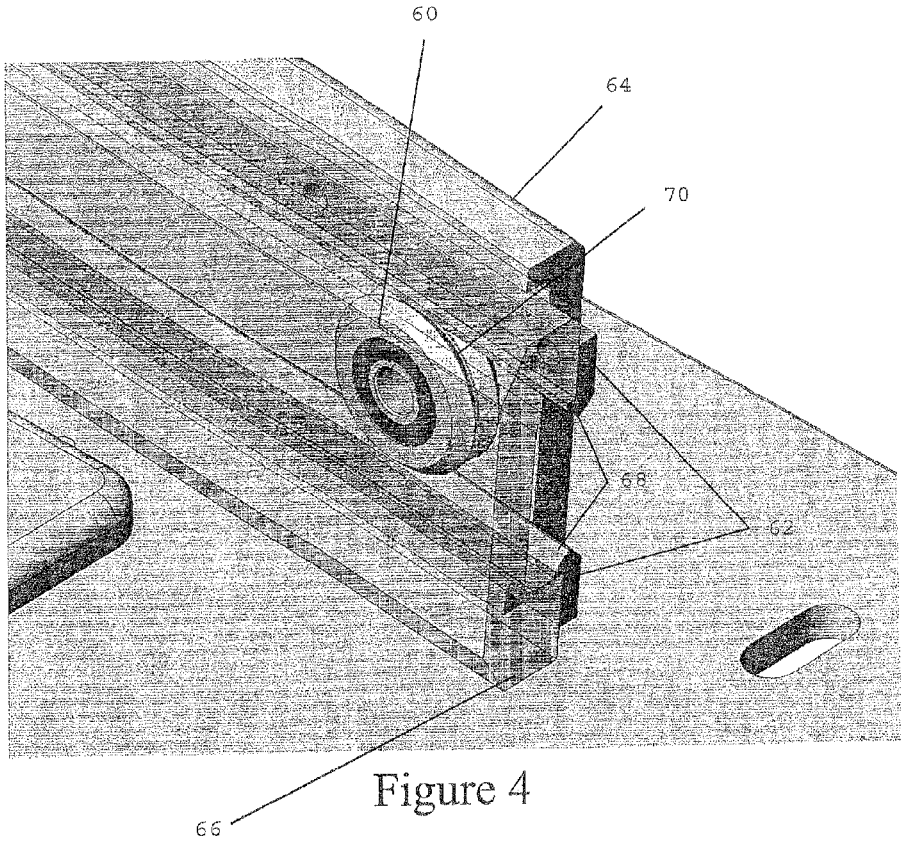
FIG. 4 depicts close up perspective view of the rail extension sliding mechanism of the embodiment of FIG. 1.

Referring in particular to FIG. 3B, each rail 14, 15 includes a rail extension 56, 58, respectively. The rail extensions 56, 58 may be coupled across the width of the rails by adjustable crossbar 57. Rail extensions 56, 58 are composed of aluminum or steel and may be extendably coupled to the rails 14, 15 in any manner known in the art. For example, referring to FIG. 4, rail 14 and rail extension 56 may be coupled to a track 62 in which one or more guide wheels 60 may move. As shown in FIG. 4, rail 15 includes a first simple U shaped body 64 on which at least one DualVee® washdown bearing guide wheel 60 is mounted. Extension 58 is composed of a second U shaped body 66 coupled to a pair of "Vee" edge tracks 62. Both the "Vee" edge track 62 and the DualVee® guide wheel 60 are manufactured by Bishop-Wisecarver Corporation. The "Vee" Edge tracks 62 are so named for the V shaped protrusions 68 extending into a groove 70 in the DualVee® guide wheel 60. The protrusion 68 engages the groove 70 and the groove 70 directs and guides the extension 58 as the guide wheel 60 rotates and the extension 58 is extended.

Figure 7:
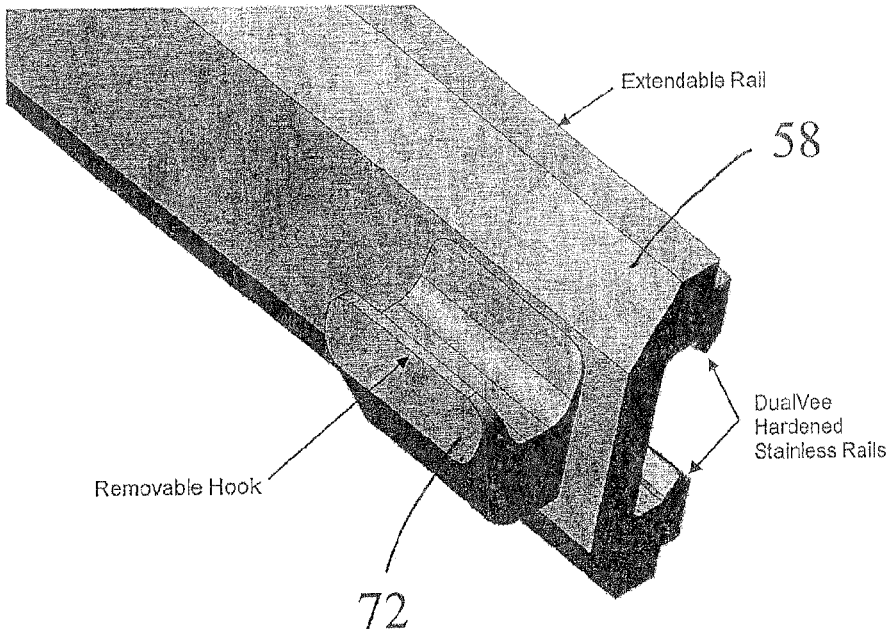
FIG. 7 is a close up perspective view of the end of the rail extension of FIG. 1.
Figure 8A:
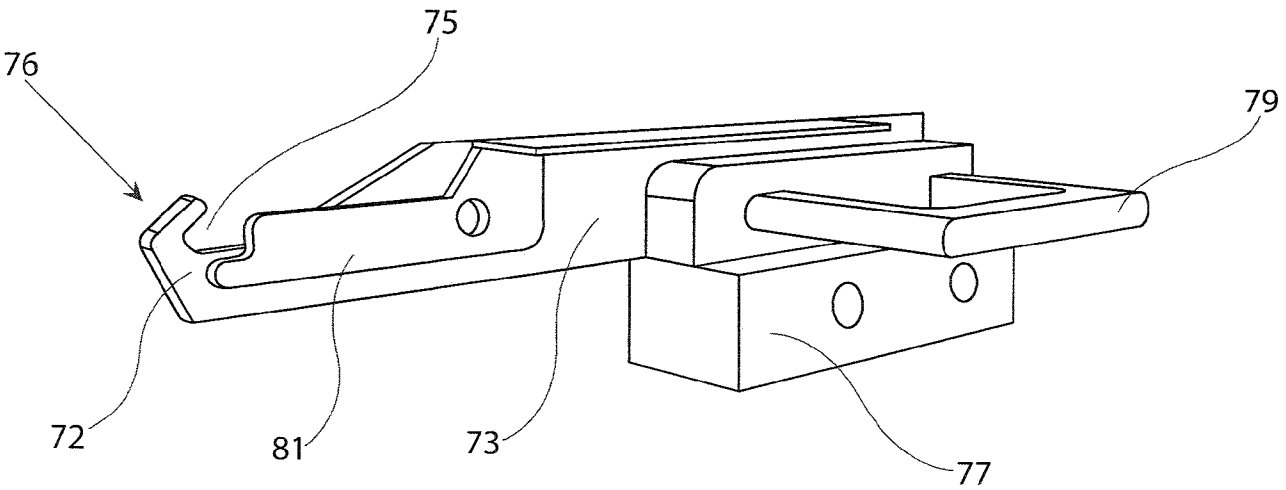
FIG. 8A is a close up perspective view of the interface hook of one embodiment of the invention and FIG. 8B is a cross sectional view of the interface hook of FIG. 8A.
Figure 8B:
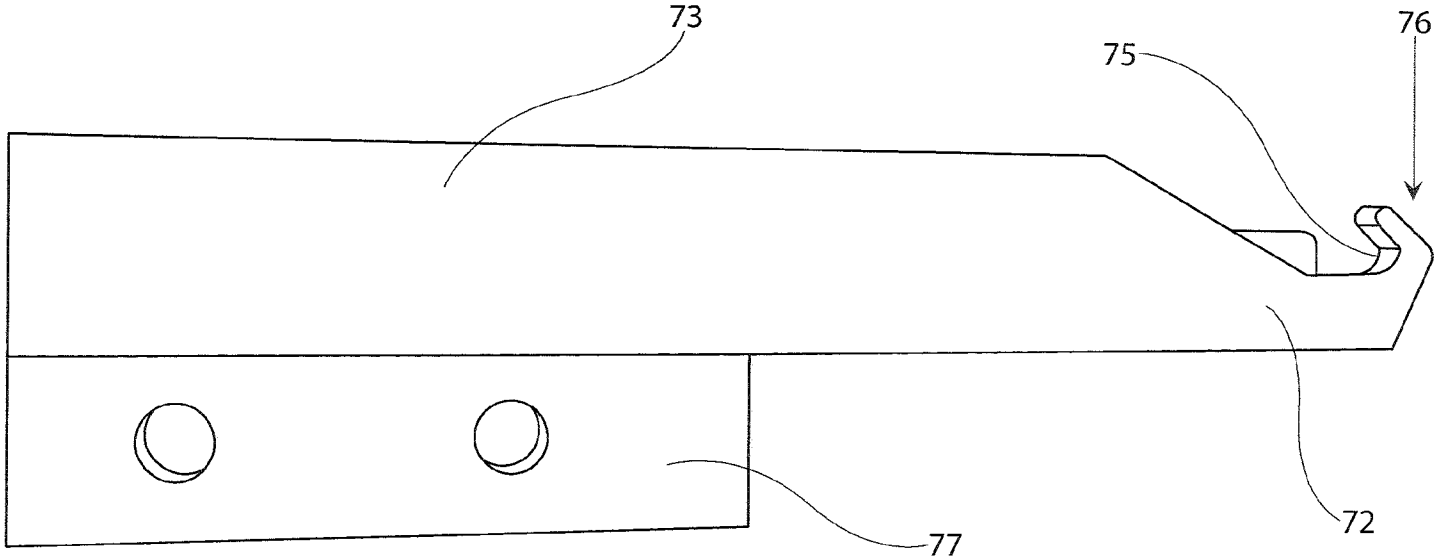
Figure 9A:
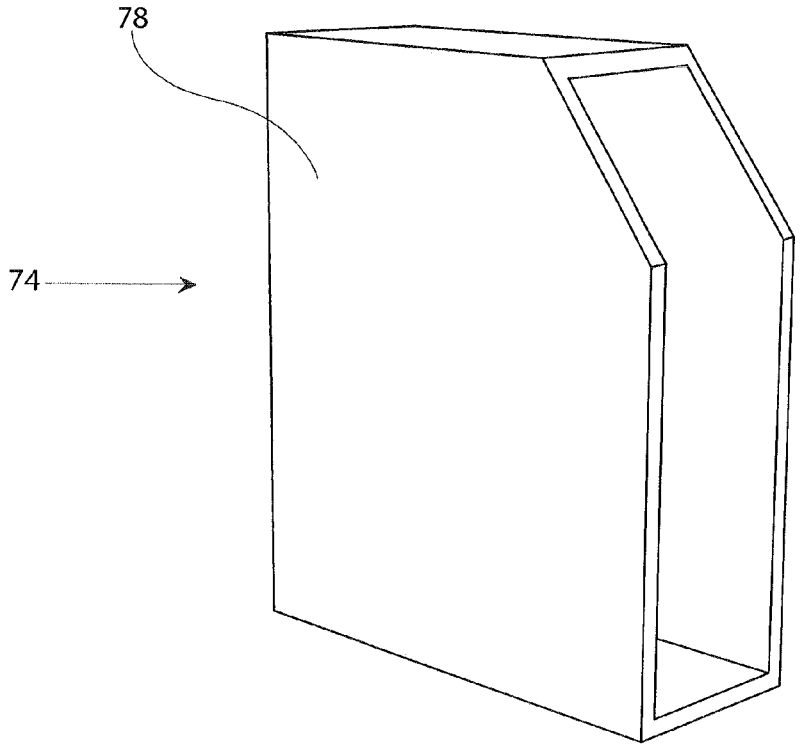
FIG. 9A is a close up perspective view of the coupling hook of one embodiment of the invention and FIG. 9B is a cross sectional view of the coupling hook of FIG. 9A.
Figure 9B:
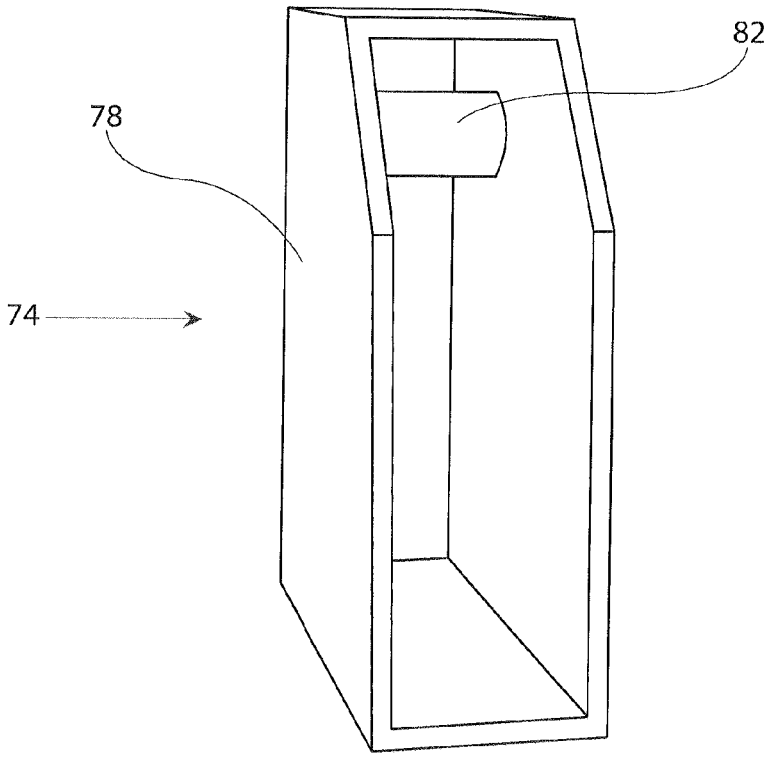
Figure 10:
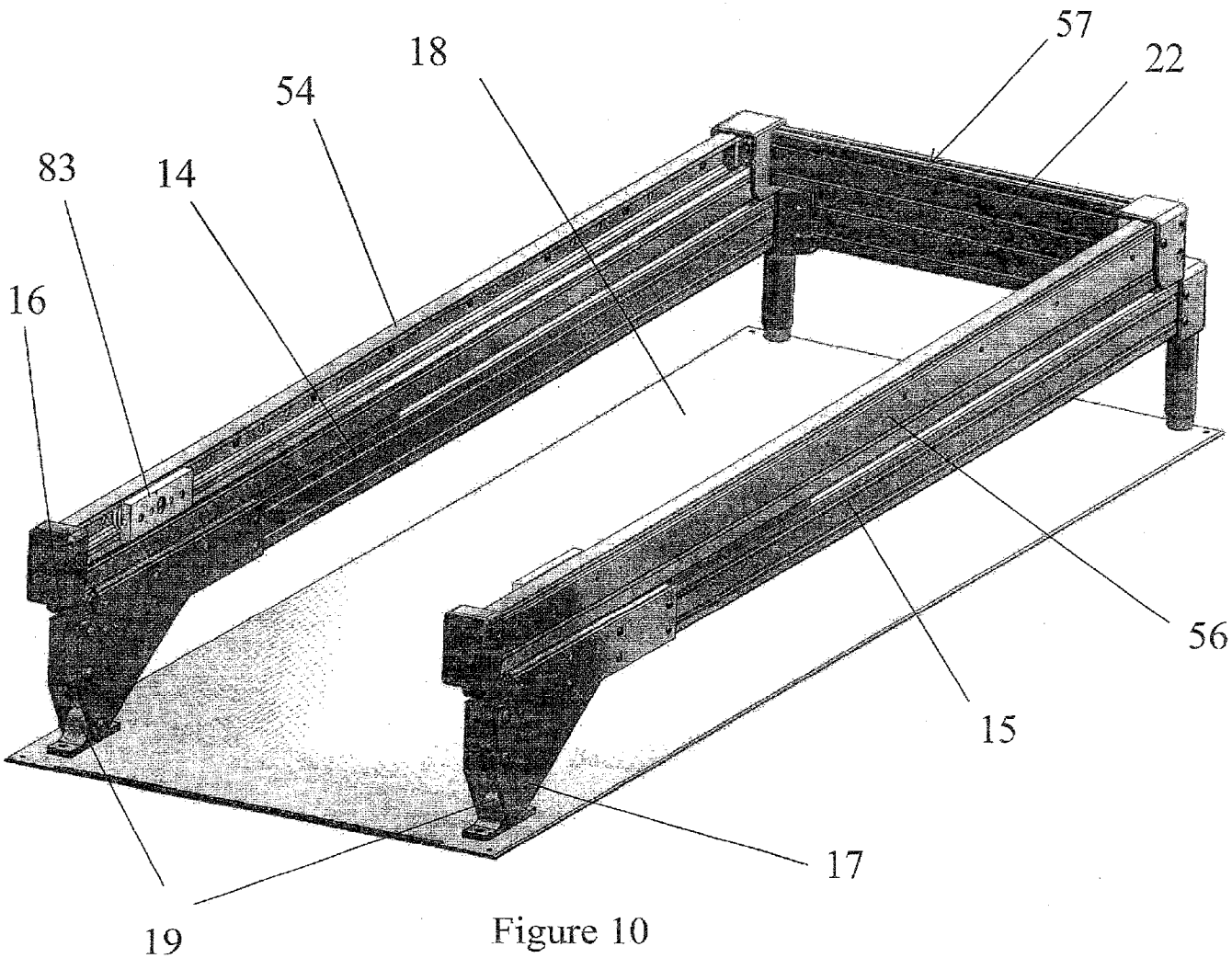
FIG. 10 is a perspective view of another embodiment of the transport patient lift system.
Figure 11:
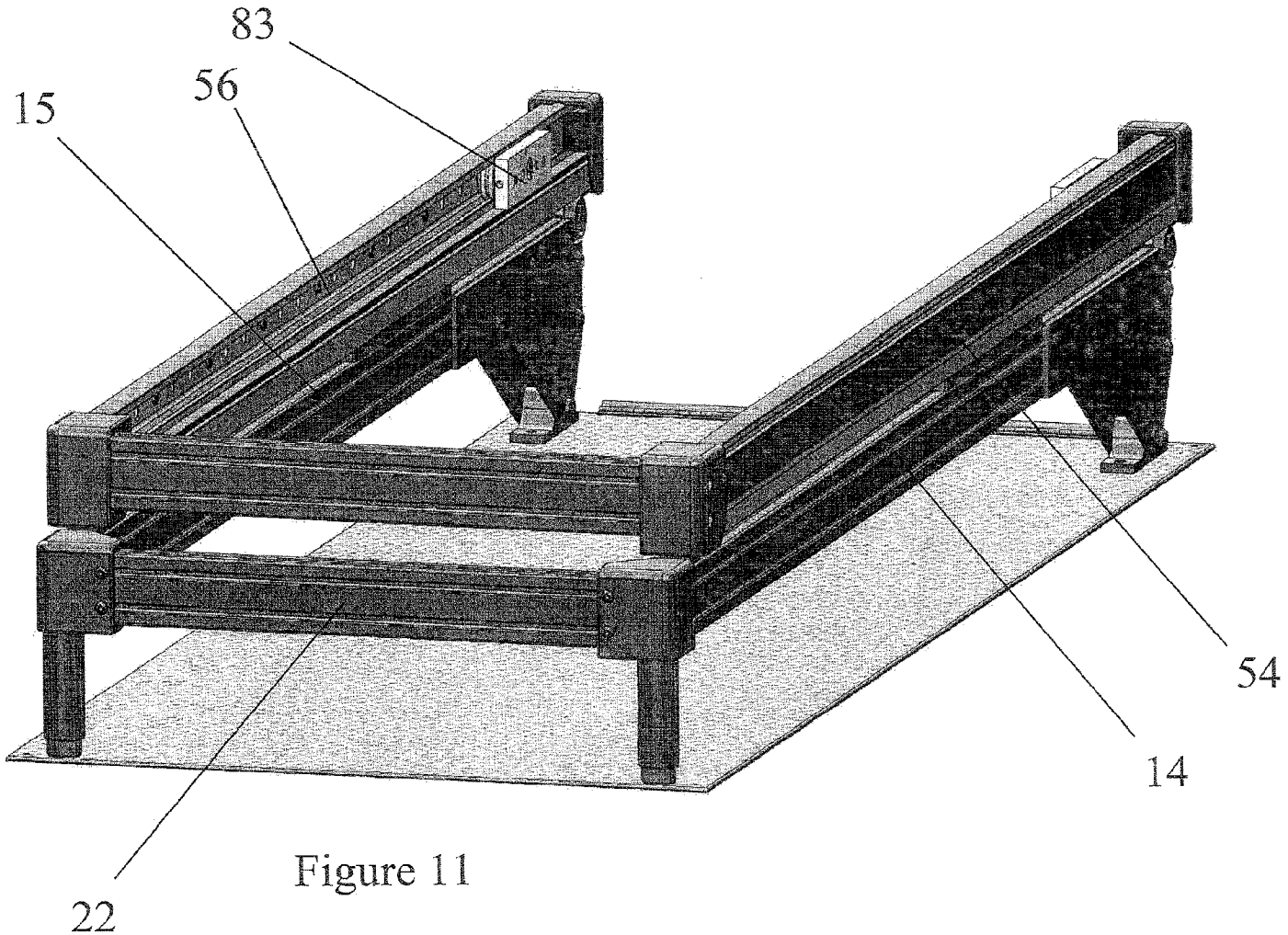
FIG. 11 is a rear perspective view of the embodiment of FIG. 10.
Figure 12:
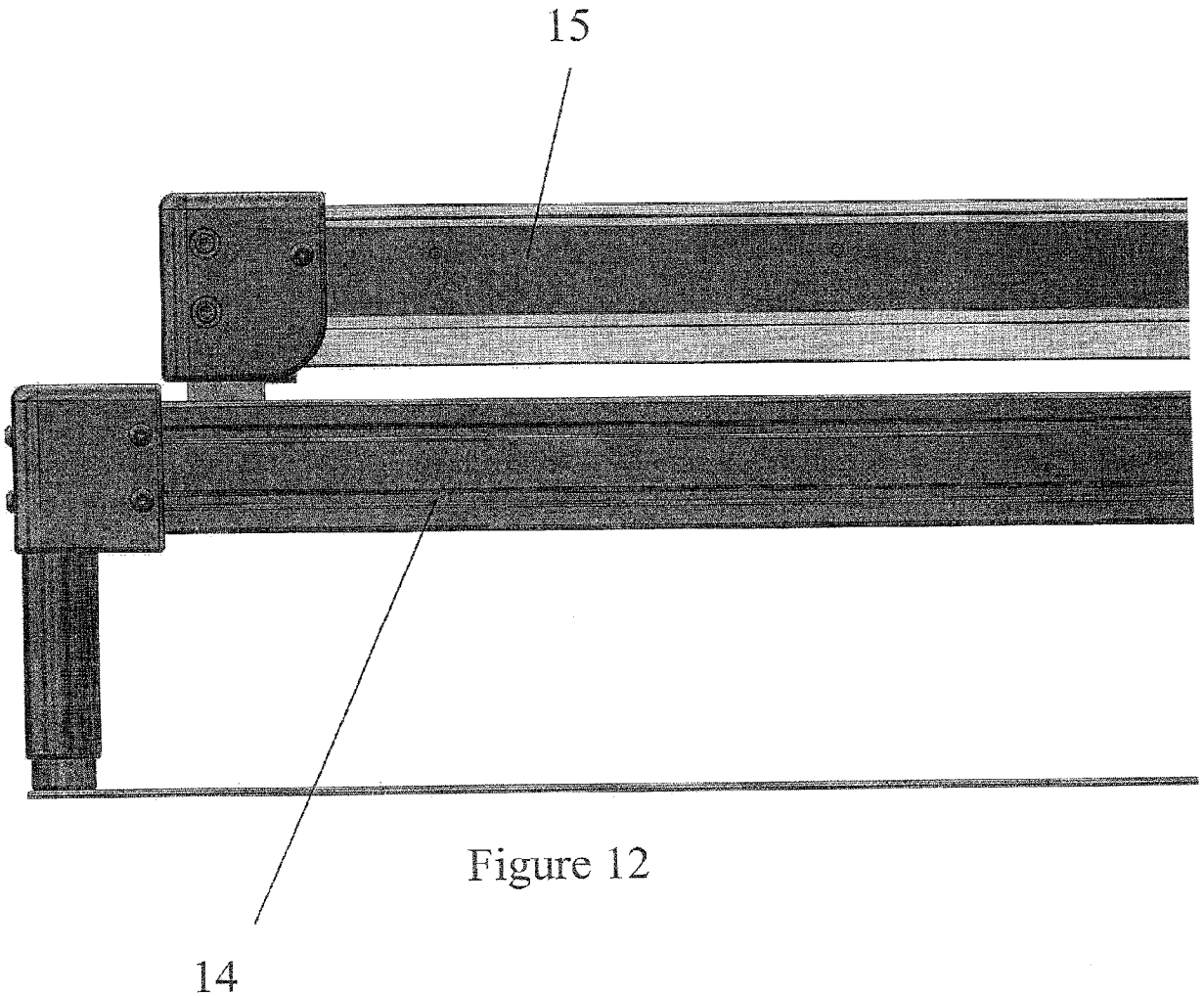
FIG. 12 is a close up side view of the rear portion of the embodiment of FIG. 10.
Figure 13:
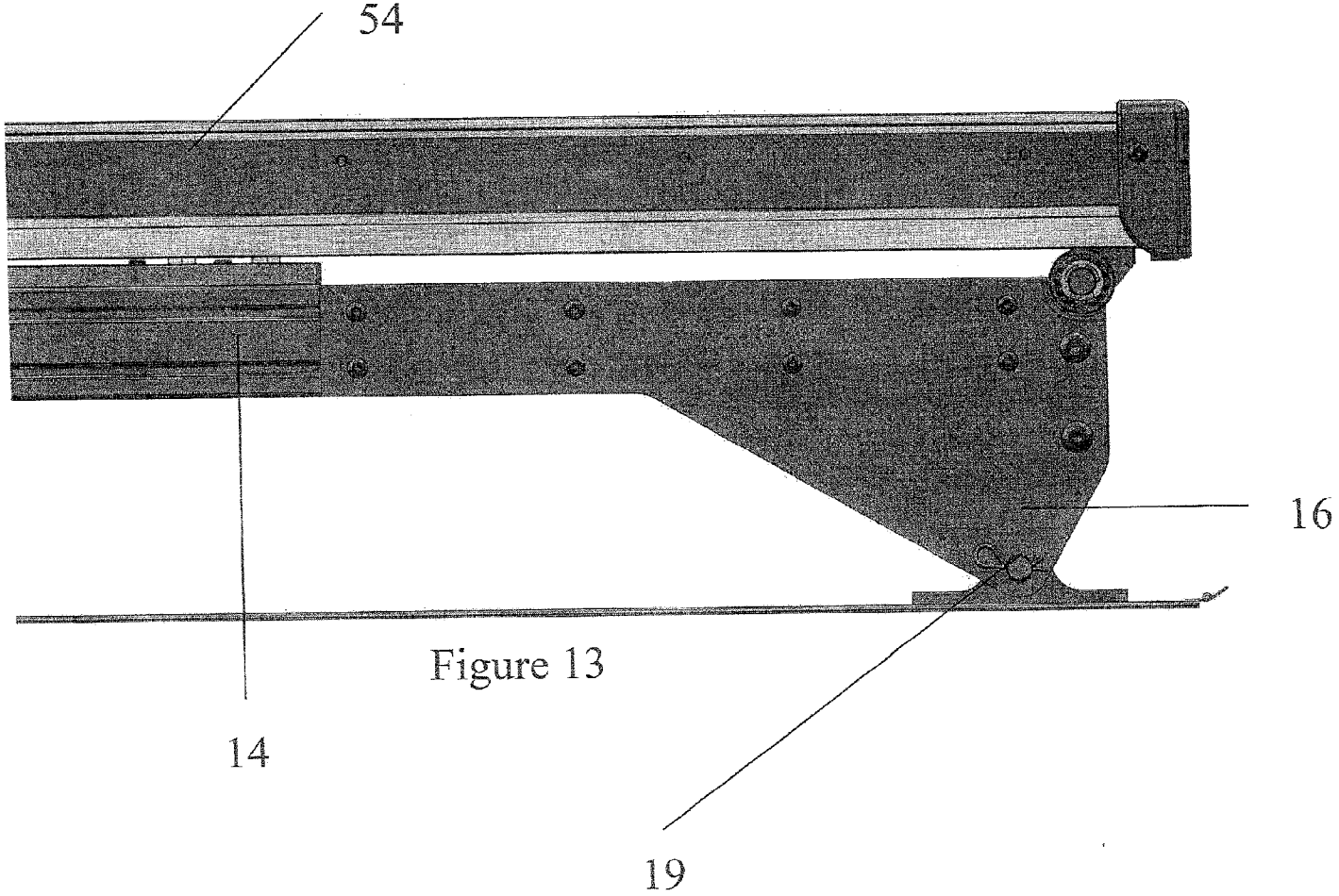
FIG. 13 is a close up side view of the front portion of the embodiment of FIG. 10.

An interface hook 72, such as that shown in FIG. 7 and, in an alternative embodiment in FIGS. 8A-B, is coupled to each extension 56, 58. Interface hook 72 engages the support frame 104 of the cot 10, supporting and lifting the cot 10 by the sturdy support frame 104. if desired, a coupling hook 74, such as that shown in FIG. 9A-B may be fixed to the cot 10 to quickly, securely, and releasably engage the interface hook 72. Additionally, the interface hook 72 may be coupled to the extension 56 or 58 via a hinge or the coupling hook 74 may be fixed to the support frame 104 via a hinge that allows the interface hook 72, the coupling hook 74, or both, to rotate as the lift mechanism 24 is operated.

Interface hook 72 may be coupled to the extension 56, 58 by a length of material (not shown) such as wire, strapping, or rope. The length of material may couple at a Y shaped joint such that one portion of the interface hook 72 couples to the support frame 104 at the head end 106 and another portion of the interface hook 72 couples to the support frame 104 at the feet end 108 on each side of the support frame 104. The length of the length of material may be adjustable by a winch or other mechanism familiar to one having skill in the art. In this way, the lift mechanism of the invention may be used to assist emergency response personnel to lift the loaded cot from a position very near to the ground. In this embodiment, the loaded cot may be wheeled adjacent to the ambulance while the wheel carriage 102 is at least partially compacted. With the rail extensions 54, 56 extended, the length of material is deployed to allow the interface hook 72 to couple to the cot 10 at some distance from the extension 54, 56. The linear actuator 26 may then be operated to lift the rail extensions 54, 56 relative to the ground, lifting the cot 10 from its lowered position. When the cot is raised sufficiently, the wheel carriage 102 may be fully extended to support the cot 10 as the interface hook 72 is adjusted to be in position to load the cot as described by the method below.

Figure 14:
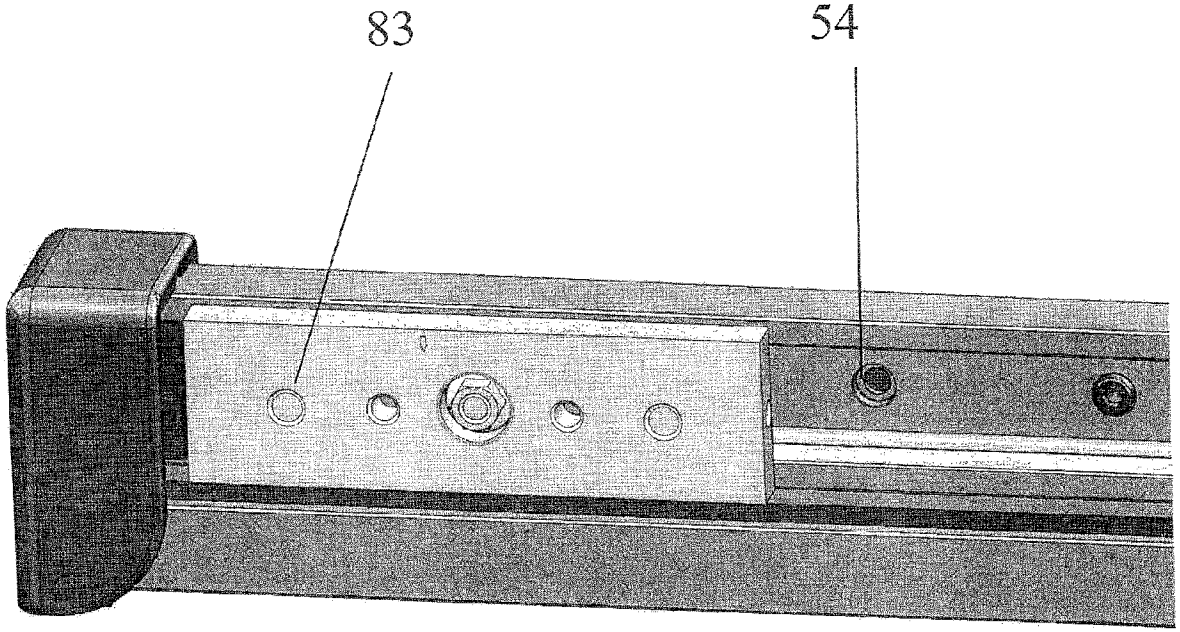
FIG. 14 is a close up perspective view of the inside rail of the embodiment of FIG. 10.
Figure 15:
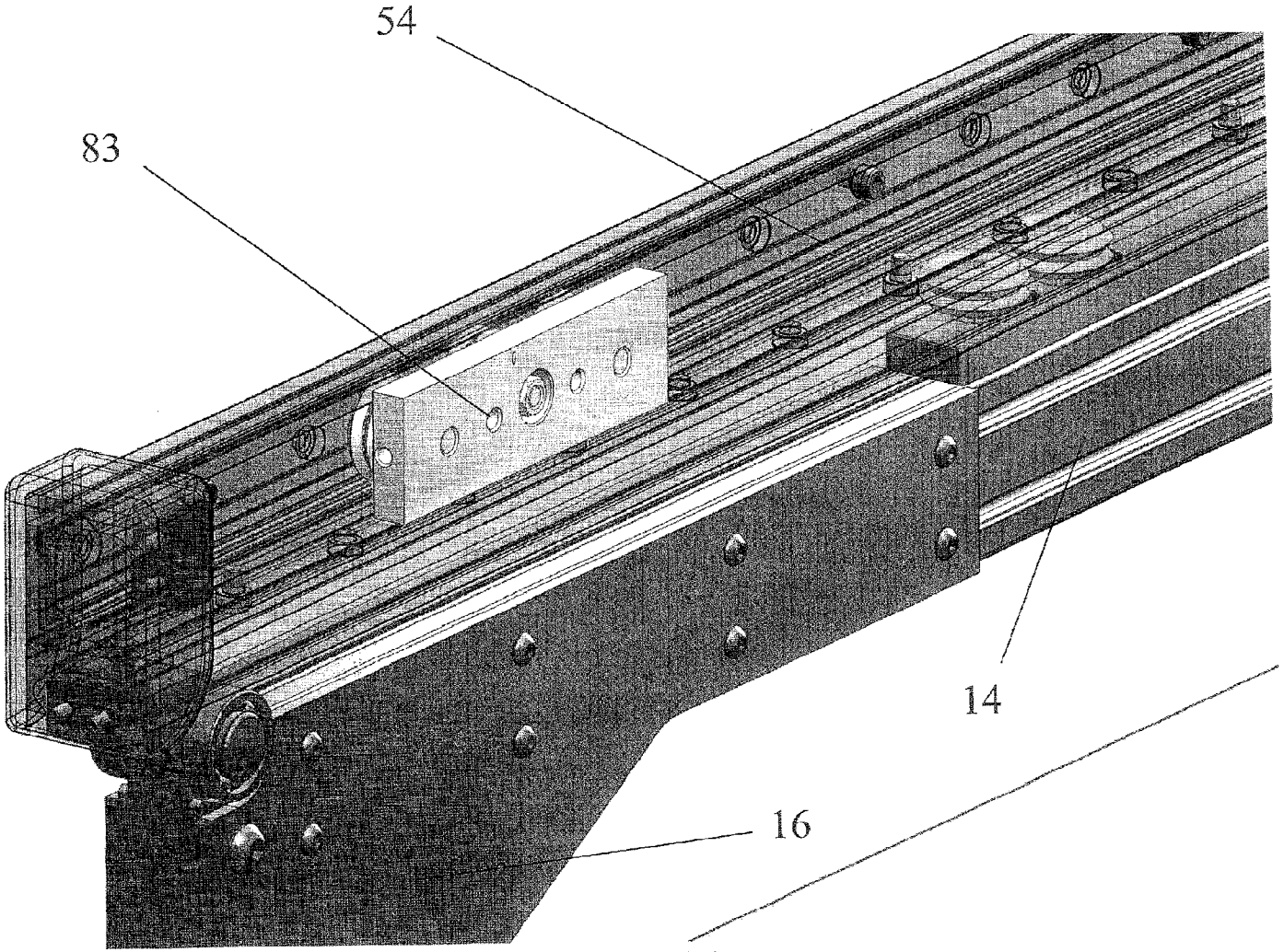
FIG. 15 is a perspective partially transparent view of the inside rail of the embodiment of FIG. 10.
Figure 16:
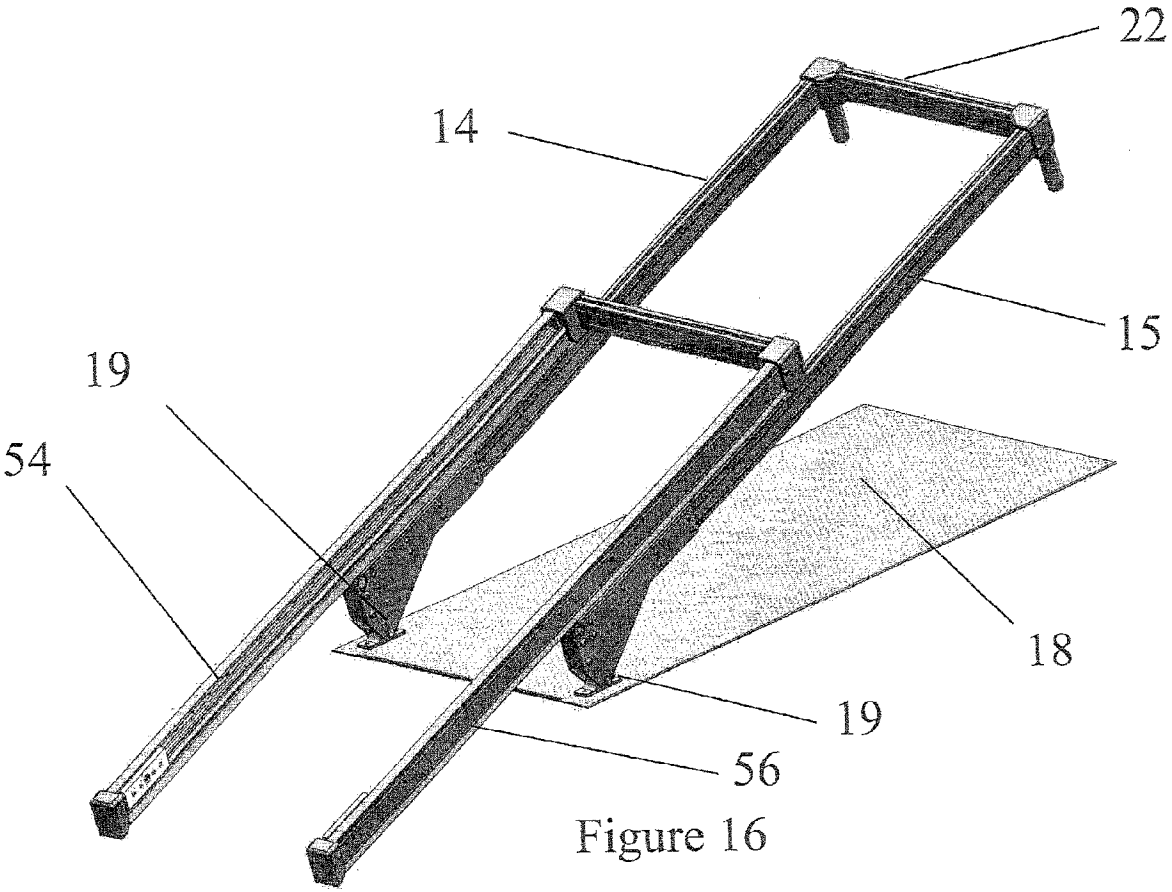
FIG. 16 is a perspective view of the embodiment of FIG. 10 in an extended position.

In one embodiment, the interface hook 72 is attached to the rail extension 56 or 58 and is configured as shown in FIGS. 8A-B. Interface hook 72 may comprise a body 73 that is extended in the direction of the axis of the rails 14, 15. Body 73 includes a recess 75 and a tapered portion 76. The extended body 73 may be coupled to the interior of the rails 14, 15, via a link 77. Link 77 may conveniently couple with a sliding link interface 83, best shown in FIG. 14. Link 77 may include a handle 79, to allow the user to slide the interface hook 72 relative to the rails 14, 15. A rollover bar 81 may be coupled adjacent to the interface hook 72 to secure the cot 10 in the event of a rollover accident in the ambulance. Interface hook 72 conveniently couples with coupling hook 74 shown in FIGS. 9A and 9B.

Coupling hook 74 includes a support casing 78 on each side of the support frame 104. Each support casing 78 may be directly coupled to the support frame 104, or may be coupled to a crossmember 80 that is coupled to the support frame 104. The support casings 78 are spaced to align with the interface hooks 72. The interior of the support casing 78 includes a secure support pin 82 spanning the support casing 75 in a direction substantially perpendicular to the axis of the rails 14, 15.

Interface hook 72 may be coupled to the rail extension by a spring pivot 84. Spring pivot 84 biases the interface hook 72 to a position substantially parallel to the rail extensions 54, 56, but allows the tapered end of the interface hook 72 to pivot down to a limited degree. The cot 10 may be coupled to the rail extensions 54, 56 by inserting the interface hook 72 into the support casing 75 of the coupling hook 74. During insertion, the tapered portion 76 of the interface hook 72 engages the support pin 82. The force of further movement of the cot 10 toward the ambulance causes the support pin 82 to push against the tapered portion 76, and the spring pivot 84 allows the coupling hook 72 to pivot down and allow further insertion into the support casing 75 of the coupling hook 74. When the support pin 82 reaches the recess 75, the spring pivot 84 biases the coupling hook 74 back up and the support pin 82 resides within the recess 75, restricting the movement of support pin 82 relative to the rail extensions 54, 56.

The support casing 75 may be substantially continuous about the perimeter, forming a closed cross section. This allows the support casing to restrict the movement of the cot 10 in the event of a rollover accident or other traumatic movement of the ambulance while the cot 10 is being transported. A number of attachment mechanisms exist to couple the cot 10 to the extensions 56, 58, and the description provided above is not meant to limit one having skill in the art to the described embodiment.

The crossmember 80 may span the width 114 of the cot 10 and provide an alternative method of adjusting the lift mechanism of the invention to a variety of cot types and sizes. In this embodiment, the rails 14, 15 are non-adjustable at a width slightly greater than the maximum width of a cot 10. Crossmember 80 has an adjustable length and is coupled to both support casings 75 and coupled to the support frame 104. Extending the crossmember to its maximum length places the support casings in a position corresponding to the position of the interface hook 72. In the case of a cot 10 having the maximum width, the crossmember 80 is merely adjusted to its maximum length and locked in place. In the event of a cot 10 having a smaller width 114 than the maximum width, the fully extended crossmember 80 may snag on blankets or clothing of patients or emergency personnel, or otherwise impede movement about the cot 10 when the cot 10 is not coupled to the rails 14, 15. In this case, the crossmember 80 may be adjusted to allow the support casing 75 to be stowed adjacent to or within the periphery of the support frame 104.

In another embodiment of the invention, a method of unloading a cot 10 from an ambulance and loading the cot 10 into the ambulance with or without a patient on the cot 10 is provided. In this embodiment, a cot 10 is provided, the cot having a support frame 104, a head end 106, a foldable wheel carriage 102, and load wheels 110 beneath the head end 106 of the support frame 104. The support frame 104 has a peripheral width 114 that is wide enough to support an obese patient, but narrow enough to fit into the ambulance.

The cot 10 is loaded and unloaded into the ambulance by a rail lift device 1. Rail extensions 56, 58 are detachably coupled to the support frame 104 on each side of the support frame 104, respectively. The rail extensions 56, 58 may have manufactured, fixed dimensions to accommodate a standard ambulance cot 10 or may be adjusted to fit the support frame 104 of the cot 10 of a particular ambulance after installation of the rail lift device 1 and prior to loading the cot 10 in the ambulance. The device 1 may be adjusted to fit the particular model of cot 10 used in a given ambulance prior to, or after installation of the device 1 in the ambulance.

To adjust the device 1 to fit a particular cot 10, the adjusting nut 46 and base adjustment nut 54 are loosened and the brace 22 and legs 16, 17 described above are set at a width greater than the peripheral width 114 of the cot 10. The extensions 56, 58 are fully extended and the cot 10 to be fitted is placed in position between the extensions 56, 58. The legs 16, 17 are made narrower until the interface hook 72 is in position to couple to the support frame 104 or the coupling hook 74. The width of the brace is also adjusted such that the extensions 56, 58 and the rails 14, 16 are substantially parallel. The widths of the legs 16, 17 and the brace 22 are then secured in place by tightening the adjustment nut 46 and the base adjustment nut 54.

To deploy the cot 10, the user simply pulls the cot 10 out of the ambulance using essentially the same procedure as is currently employed to manually unload a cot 10 from an ambulance. The support frame 104 coupled to the extensions 56, 58 by the interface hooks 72 pulls the extensions 56, 58 into an extended position as shown in FIG. 3B as the cot 10 is unloaded. Alternatively, the cot may be extended from the ambulance by a mechanized piston or other mechanism familiar to one having skill in the art. When the cot 10 is deployed such that the wheel carriage 102 is clear of the ambulance, the wheel carriage 102 is unfolded into a fully extended position.

Figure 3C:
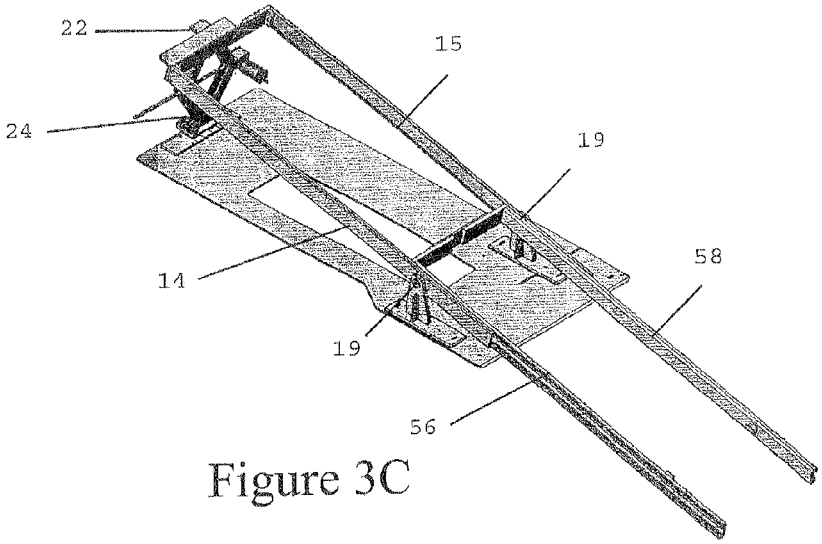
Figure 3D:
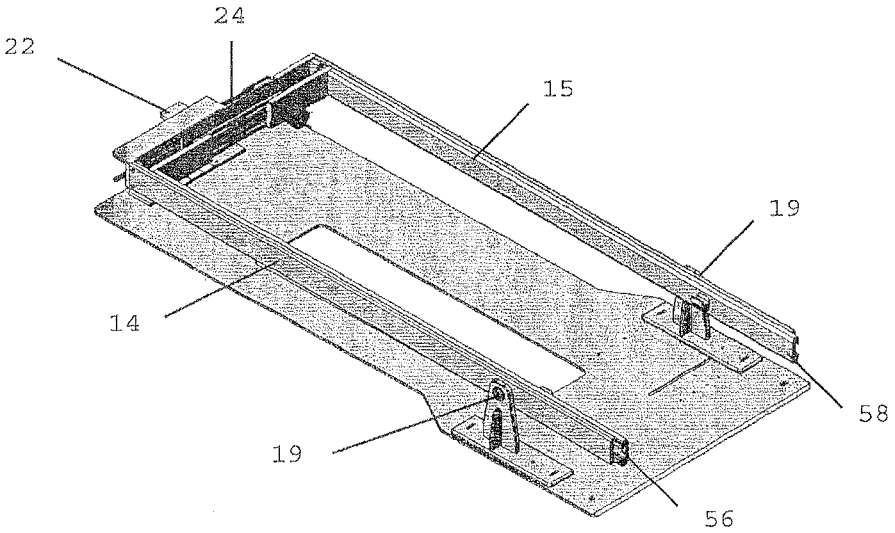
Figure 3E:
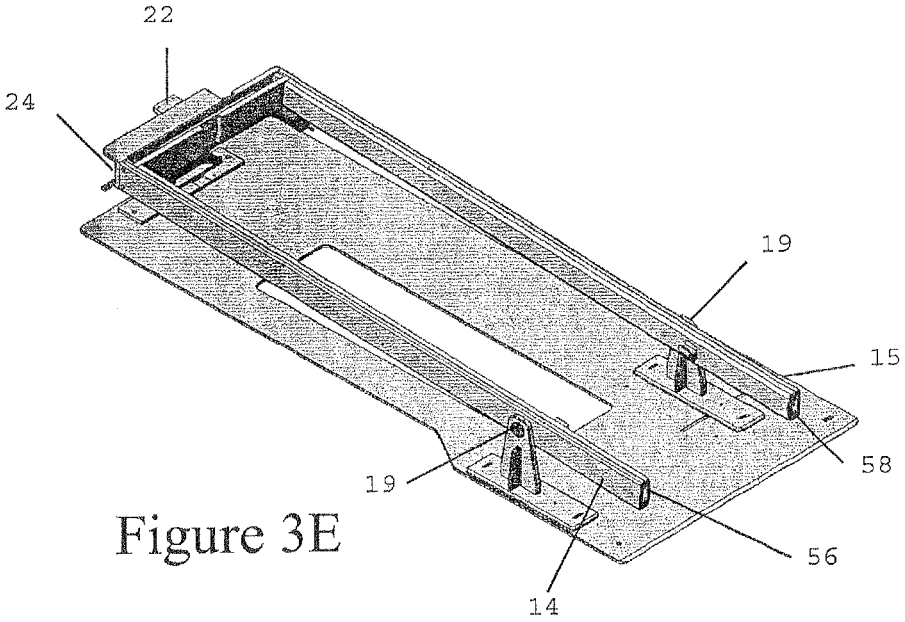

With the wheel carriage extended, the user activates the lift mechanism 24. The motor 28 of the lift mechanism 24 may be activated by a button or switch (not shown). The motor 28 extends the linear actuator 26 to lift the brace 22. The rails 14, 16 pivot about the axle 19 and the extensions 56, 58 are lowered toward the ground as shown in FIG. 3C. The lowered rail extensions concurrently lower the wheel carriage 102 into contact with the ground. With the cot supported by the ground and the load wheels 110, the interface hooks 72 are detached from the support frame 104 or the coupling hooks 74. The cot may then be deployed where it is needed. The device 1 may be withdrawn back into the ambulance as shown in FIGS. 3D-E, or left in place to receive the loaded cot 10 for loading.

To load the cot 10 back into the ambulance with the patient on board, the inhabited cot 10 is transported to the entrance to the ambulance and the load wheels 110 are placed on the interior floor of the ambulance to support at least a portion of the weight of the inhabited cot 10 as shown, for example, in FIG. 7A. The interface hooks 72 are then attached to the support frame 104 or coupling hooks 74, in one embodiment simply by retracting the linear actuator 26 to lift the extensions 56, 58 as is shown in FIG. 7B. The motor 28 of the lift mechanism 24 is activated to operate in the opposite direction when the button or switch is again deployed by the user. The motor 28 smoothly retracts the linear actuator 26, pulling the brace 22 toward the interior floor of the ambulance. The extended rails 14, 16 pivot about the axle 19 to lift the extensions 56, 58 and the support frame 104 coupled between the extensions 56, 58.

The cot 10 may be lifted completely off the ground with the entire weight of the cot 10 supported by the ambulance and the transport patient lift system 1 by fully retracting the linear actuator 26 as shown in FIG. 7C. When the linear actuator 26 is fully retracted and the rails 14, 16 and extensions 56, 58 are substantially parallel to the interior floor of the ambulance, the cot 10 may be pushed on the load wheels 110 and the wheel carriage 104 until the cot 10 is completely inside the ambulance and the head portion 106 of the support frame 104 is securely accommodated in the brace 22. The cot may then be secured to the ambulance by locking the linear actuator 26 in place, or by any other suitable method and the patient transported to receive further care as shown in FIG. 7E.

Referring to FIGS. 11-17, an alternative embodiment of the transport patient lift system 1 is depicted, absent the linear actuator 26. The rails 14, 16 of the transport patient lift system 1 are extended substantially as described above. In a particular embodiment, the transport patient lift system 1 of FIGS. 11-17 is used with a winch to raise and lower the transport patient lift system 1.

Although the preceding detailed description has provided several embodiments of a lift mechanism, alternatives are possible without departing substantially from the spirit and principles of the invention. For example, the device may be used to lift any heavy load having a support frame into a transport vehicle. Also, the lift mechanism may be actuated at the feet end of the cot, rather than at the head end of the cot, or may be coupled to the support frame using a strap or other lifting mechanism. Further, the device and method may be altered to a wheeled apparatus used to transfer a patient from one bed to another on a stretcher within a hospital or other institution involved in moving people. All such modifications and variations are intended to be included herein within the scope of this disclosure and the present invention and protected by the following claims.

We claim:

1. A lift system for use in loading a cot into and unloading a cot from an interior of an ambulance, the cot having a head end, at least one load wheel, and a support frame, the system comprising:
   - a first rail and a second rail parallel to the first rail and adjustably spaced from the first rail such that the cot may fit between the first rail and the second rail, wherein the rails are coupled to a surface of the ambulance to pivot relative to the surface of the ambulance;
   - a linear actuator coupled to the ambulance and to the rails, wherein the linear actuator has a length and is configured to mechanically vary the length of the linear actuator;
   - a first extension coupled to the first rail such that the first extension may move axially relative to the first rail;
   - a second extension coupled to the second rail such that the second extension may move axially relative to the second rail;
   - a first interface hook coupled to the first extension and a second interface hook coupled to the second extension such that the interface hooks may be detachably coupled to the support frame such that activation of the linear actuator pivots the extension to support at least a portion of the weight of the cot.

2. The lift system of claim 1, wherein the linear actuator is a motorized winch.

3. The lift system of claim 1, wherein the interior of the ambulance has a load end and a cab end opposite the load end and wherein the linear actuator is fixedly coupled to the interior of the ambulance adjacent to the cab end.

4. The lift system of claim 1, wherein the first rail and the second rail are coupled by a brace.

5. The lift system of claim 4, wherein the brace is shaped to accommodate a portion of the support frame of the cot.

6. The lift system of claim 1, wherein the interface hook is shaped to define at least a partial sleeve of a portion of the support frame.

7. The lift system of claim 1, further comprising a base plate fixedly coupled to the ambulance and coupled to at least one axle wherein the space between the first rail and the second rail is adjustable by adjusting the position of the at least one axle relative to the base plate.

8. The lift system of claim 1, further comprising a first leg and a first axle coupled to the first rail, and a second leg and a second axle coupled to the second rail.

9. A method of lifting a load on a transport into and out of a vehicle having an interior floor at a height, the transport having a carriage and a support frame, the method comprising:

providing a first extendable rail and a second extendable rail parallel to the first extendable rail and adjustably spaced from the first extendable rail, each rail having a first end and a second end substantially enclosed in the vehicle, wherein the rail is able to pivot relative to the vehicle about an axle;

extending the rails outside of the vehicle;

allowing the rails to pivot, bringing the second end of the rail in closer proximity to the transport;

coupling the rails to the support frame of the transport;

pivoting the rails about the axle while the rails are coupled to the support frame of the transport sufficiently to raise the carriage of the transport to the height of the interior floor of the vehicle; and laterally manipulating the transport into the vehicle.

10. The method of claim 9, further comprising the step of adjusting the rail width to substantially equal the peripheral width of the support frame.

11. A lift system for use in loading a cot into and unloading a cot from an interior of an ambulance, the cot having a head end, at least one load wheel, and a support frame, the system comprising:

a first rail and a second rail parallel to the first rail and spaced from the first rail such that the cot may fit between the first rail and the second rail, wherein the rails are coupled to a surface of the ambulance to pivot relative to the surface of the ambulance;

a linear actuator coupled to the ambulance and to the rails, wherein the linear actuator has a length and is configured to mechanically vary the length of the linear actuator;

a first extension coupled to the first rail such that the first extension may move axially relative to the first rail;

a second extension coupled to the second rail such that the second extension may move axially relative to the second rail;

an adjustable length crossmember coupled to the support frame;

a first interface hook coupled to the first extension and a second interface hook coupled to the second extension such that the interface hooks may be detachably coupled to the adjustable length crossmember such that activation of the linear actuator pivots the extension to support at least a portion of the weight of the cot.

* * * * *